US006861997B2

(12) United States Patent
Mahon

(10) Patent No.: US 6,861,997 B2
(45) Date of Patent: Mar. 1, 2005

(54) PARALLEL PLATE SEPTUM POLARIZER FOR LOW PROFILE ANTENNA APPLICATIONS

(76) Inventor: John P. Mahon, 338 Avenida del Royale, Thousand Oaks, CA (US) 91362

( * ) Notice: Subject to any disclaimer, the term of this patent is extended or adjusted under 35 U.S.C. 154(b) by 28 days.

(21) Appl. No.: 10/318,562

(22) Filed: Dec. 13, 2002

(65) Prior Publication Data

US 2003/0142028 A1 Jul. 31, 2003

Related U.S. Application Data

(60) Provisional application No. 60/340,701, filed on Dec. 14, 2001.

(51) Int. Cl.[7] ..... H01Q 13/00

(52) U.S. Cl. ..... 343/772; 343/776; 333/125; 333/137

(58) Field of Search ..... 343/776, 772, 343/786; 385/11; 333/125, 137, 21 A; H01Q 13/00

(56) References Cited

U.S. PATENT DOCUMENTS 4,395,685 A * 7/1983 Davies et al. ..... 333/125
5,061,037 A * 10/1991 Wong et al. ..... 385/11
6,577,207 B2 * 6/2003 Volman ..... 333/125

* cited by examiner

*Primary Examiner*—Hoanganh Le
(74) *Attorney, Agent, or Firm*—Robert J. Schaap

(57) ABSTRACT

A parallel plate septum polarizer used in low profile, dual polarized, antenna applications such as satellite communications from a moving vehicle. The polarizer allows a wide waveguide to be fed from two thinner waveguides. Each thin waveguide operates with one propagating mode. These modes have the same field structure, wave velocity and wave impedance. Three waveguide modes can propagate in the wide guide. Two modes are desirable and are used to transmit or receive dual polarized signals. They have different field structures, wave velocities and impedances. The polarizer allows each mode in the thin guides to couple to both the desired modes in the wide guide. At the same time there is very little coupling with each other and with the undesired third mode in the wide guide. There is also very little reflection of the incident modes from the polarizer junction.

27 Claims, 8 Drawing Sheets

PARALLEL PLATE SEPTUM POLARIZER FOR LOW PROFILE ANTENNA APPLICATIONS

RELATED APPLICATION

This application is based on derives the benefit of my U.S. Provisional Patent Application Ser. No. 60/340,701 filed Dec. 14, 2001, for Parallel Plate Septum Polarizer for Low Profile Antenna Applications.

BACKGROUND OF THE INVENTION

1. Field of the Invention

The invention relates to a polarizer for use in dual polarized antennas fed by parallel plate waveguides. These antennas are often used in applications where an antenna with an elongated aperture is required. Important examples are low profile tracking antennas for satellite communication to/from moving vehicles (automobiles, boats and airplanes).

2. Brief Description of Related Art

It is often necessary in communication systems to feed or receive dual polarized signals to or from the antennas. The two polarizations allow two separate signals to be used at the same frequency and time. It is also necessary to separate the two signals in the circuitry attached to the antenna.

One device which is commonly used to both separate the signals and produce good quality circular polarization is the septum polarizer. In its usual form, this polarizer consists of two rectangular waveguides which are placed "piggy-back", one on top of the other, so that they share a common broad wall. This wall is cut away to form a shaped taper so that at the end of the taper the cavity enclosed by the other walls defining the waveguides become square in shape. Some designs cut the wall in steps. Others use a smooth taper. The operation and design of this type of device has been discussed in the literature. See "A Wide-Band Square-Waveguide Array Polarizer" by Ming Hui Chen and G. N. Tsandoulas IEEE *APS Transactions* May 1973 pp 389–391. See also "A New Type of Circularly Polarized Antenna Element" by D. Davis, O. J. Digiandomenico and J. A. Kempic, in *G-AP Symp. Dig.,* 1967 pp. 26–33. 33.

The septum polarizer has three physical ports, i.e., two rectangular waveguides and one square waveguide. However, it has four electrical ports since the square waveguide can support two independent signals with orthogonal polarizations. It is possible to design the taper in the common wall so that the signals in the two rectangular waveguides are well isolated from each other. At the same time, the two polarizations in the square waveguide are also well isolated. Essentially, the signal in one of the rectangular waveguides couples to only one of the polarizations in the square waveguide. Similarly, the signals in the other rectangular waveguide couple to the other polarization in the square waveguide. Usually, the device is designed so that the two orthogonal polarizations in the square waveguide are circularly polarized, or nearly so.

In a number of antenna applications, it is necessary to use an elongated aperture where one dimension of the aperture is much larger that the other. Antennas used in low profile tracking applications, such as those mounted on moving vehicles, are good examples. In these applications, it would be useful to be able to feed the antenna with a parallel plate waveguide. The signals in the waveguide can be collected or injected via an array of probes or by use of a parabolic reflector. An example of this is the invention in U.S. Pat. No. 2,638,546. This type of antenna can be manufactured inexpensively and can be made to have high aperture efficiency. However, this antenna is usually only used with a single linear polarization. The electric field is polarized perpendicular to the metal plates forming the parallel plate waveguide. With the addition of an external polarizer, it can also be used in a single circularly polarized mode.

There are two difficulties in using the parallel plate waveguide in a dual polarized manner. If the spacing between the plates is separated wide enough to allow two orthogonal modes to propagate, a third undesired mode can propagate. This mode is polarized in the same direction as the original mode i.e. perpendicular to the plates but has an anti-symmetric distribution across the guide. Also, the two desired modes behave very differently, they have very different propagation constants and wave impedances.

The design of a feed network that would work well for both desired modes and not produce the undesired mode is a very challenging problem. An alternative is to produce a device, similar to the rectangular waveguide septum polarizer, which has two identical piggy-back waveguides which launch/receive the two dissimilar parallel plate modes in an orthogonal manner. Now the signals in the two identical waveguides can be combined/divided in separate but parallel circuits. The invention disclosed performs this exact function.

SUMMARY OF THE INVENTION

Like the rectangular waveguide septum polarizer, the invention consists of two waveguides which share a common wall. This type of polarizer is especially effective with satellite communications to and from a moving vehicle. Also like the rectangular septum polarizer, the common wall is cut away so that the waveguides open out to a waveguide whose height is roughly twice the height of the other two. The differences are that all three waveguides in the new device are parallel plate waveguides and the shape of the cut in the common wall resembles the teeth of a wood saw.

Also like the rectangular waveguide septum polarizer, the new device has three physical ports i.e., two narrowly spaced parallel plate guides and one widely spaced parallel plate guide. However it has four electrical ports since the wide guide supports two orthogonal polarizations.

The coupling of the modes in the new device is also very similar to that of the rectangular waveguide septum polarizer. By appropriate design of the septum (the central common plate), the TEM mode in each narrow guide couples approximately half of its power to each of the TEM and $TE_1$ modes in the wide guide. Also, very little power is coupled to the $TM_1$ mode in the wide guide and very little power is coupled to the TEM mode in the other narrow guide, and very little power is reflected back along the original narrow guide.

This invention possesses many other advantages and has other purposes which may be made more clearly apparent from a consideration of the forms in which it may be embodied. These forms are shown in the drawings forming a part of and accompanying the present specification. They will now be described in detail for purposes of illustrating the general principles of the invention. However, it is to be understood that the following detailed description and the accompanying drawings are not to be taken in a limiting sense.

BRIEF DESCRIPTION OF THE DRAWINGS

The invention will be understood fully with reference to the drawings, where.

DETAILED DESCRIPTION OF A PREFERRED EMBODIMENT

Figure 1:
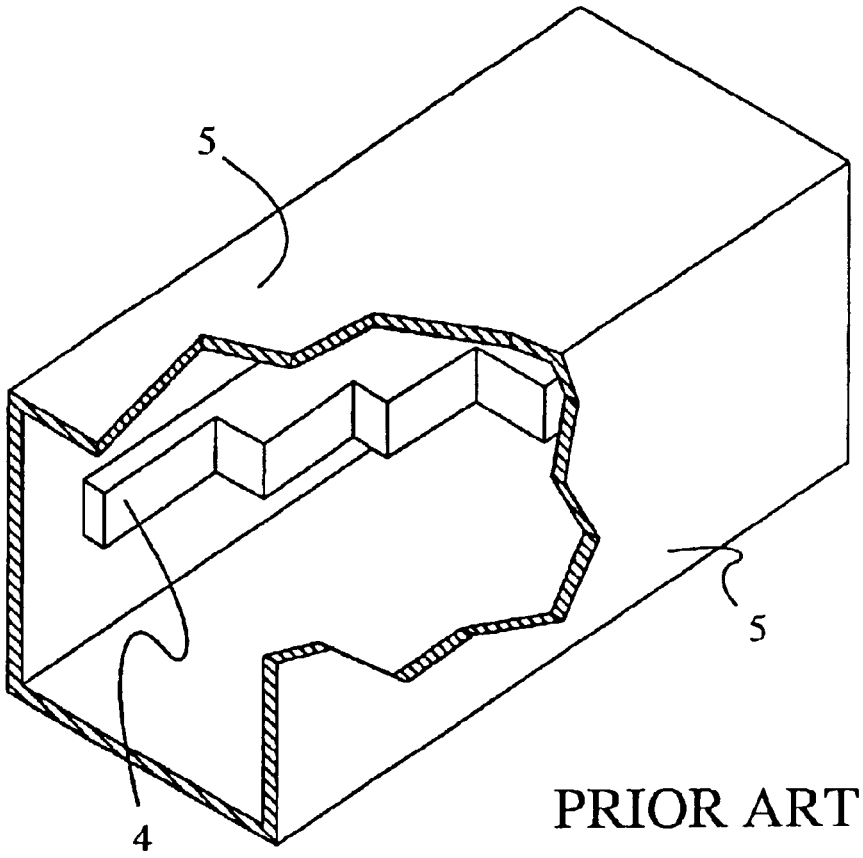
FIG. 1 is a perspective drawing illustrating a prior art septum polarizer in rectangular waveguides. This drawing illustrates a design where the common wall is cut in steps.
Figure 2:
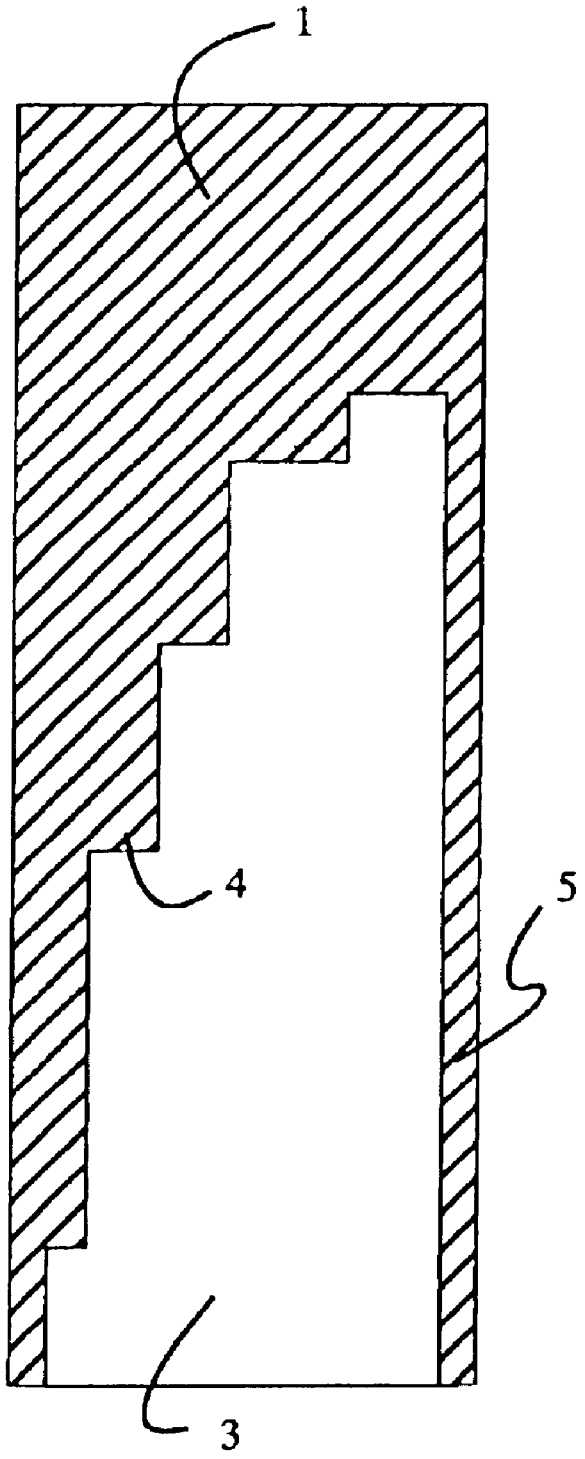
PRIOR ART FIG. 2
FIG. 2 is a cross-section view of the prior art rectangular septum polarizer of FIG. 1. The section is taken through the center of the center plate.
Figure 3:
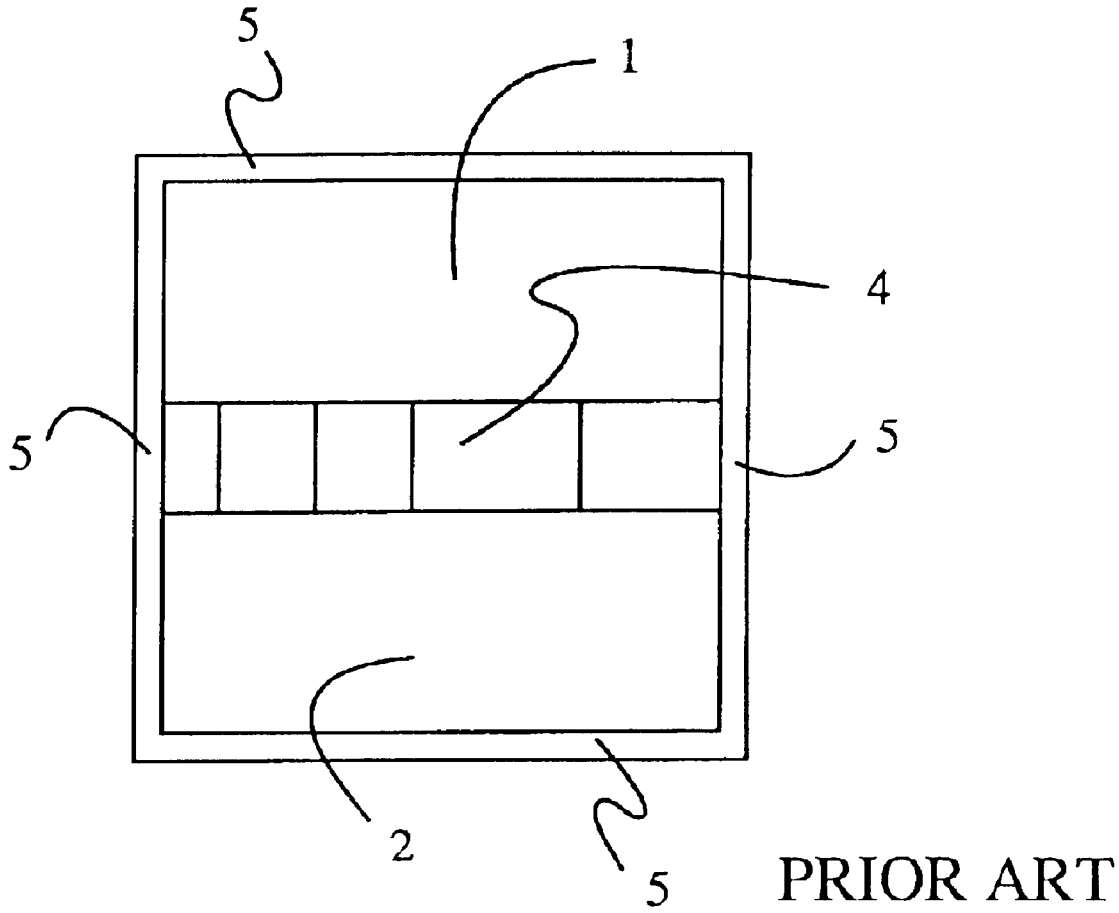
FIG. 3 is an end view of the prior art rectangular waveguide septum polarizer. This drawing shows clearly the upper and lower rectangular waveguides and the edges of the steps in the center wall septum.
Figure 4:
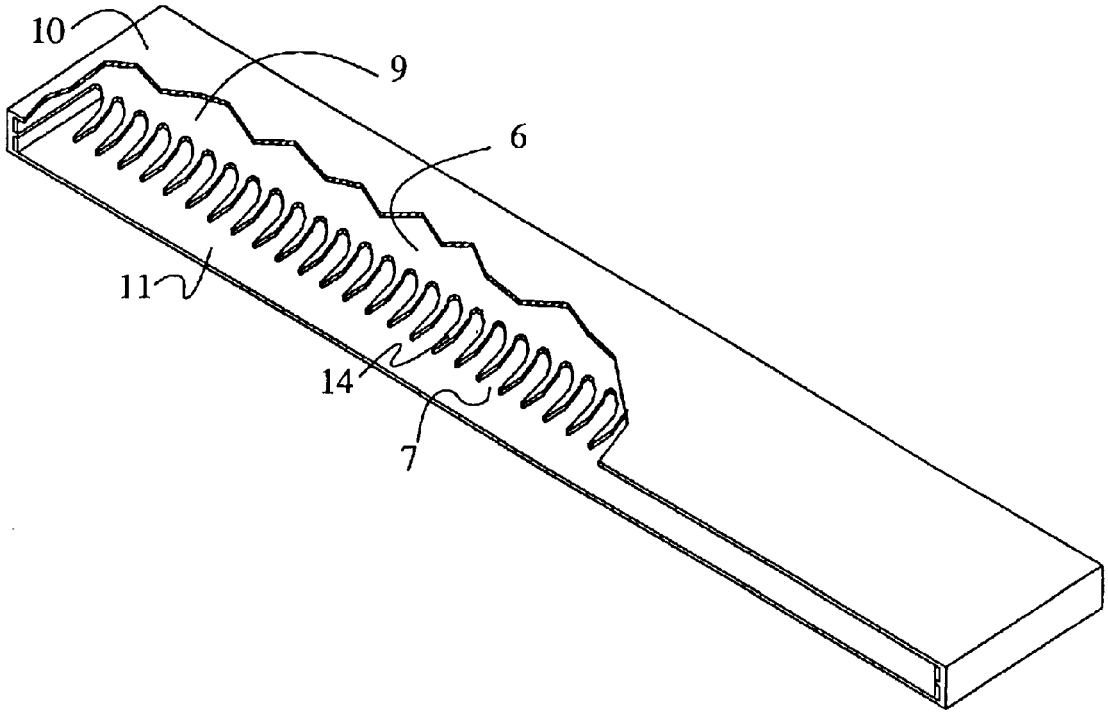
FIG. 4 is an enlarged perspective drawing of one implementation of the invention. Some of the top plate is cut away to show some of the polarizer teeth.
Figure 5:
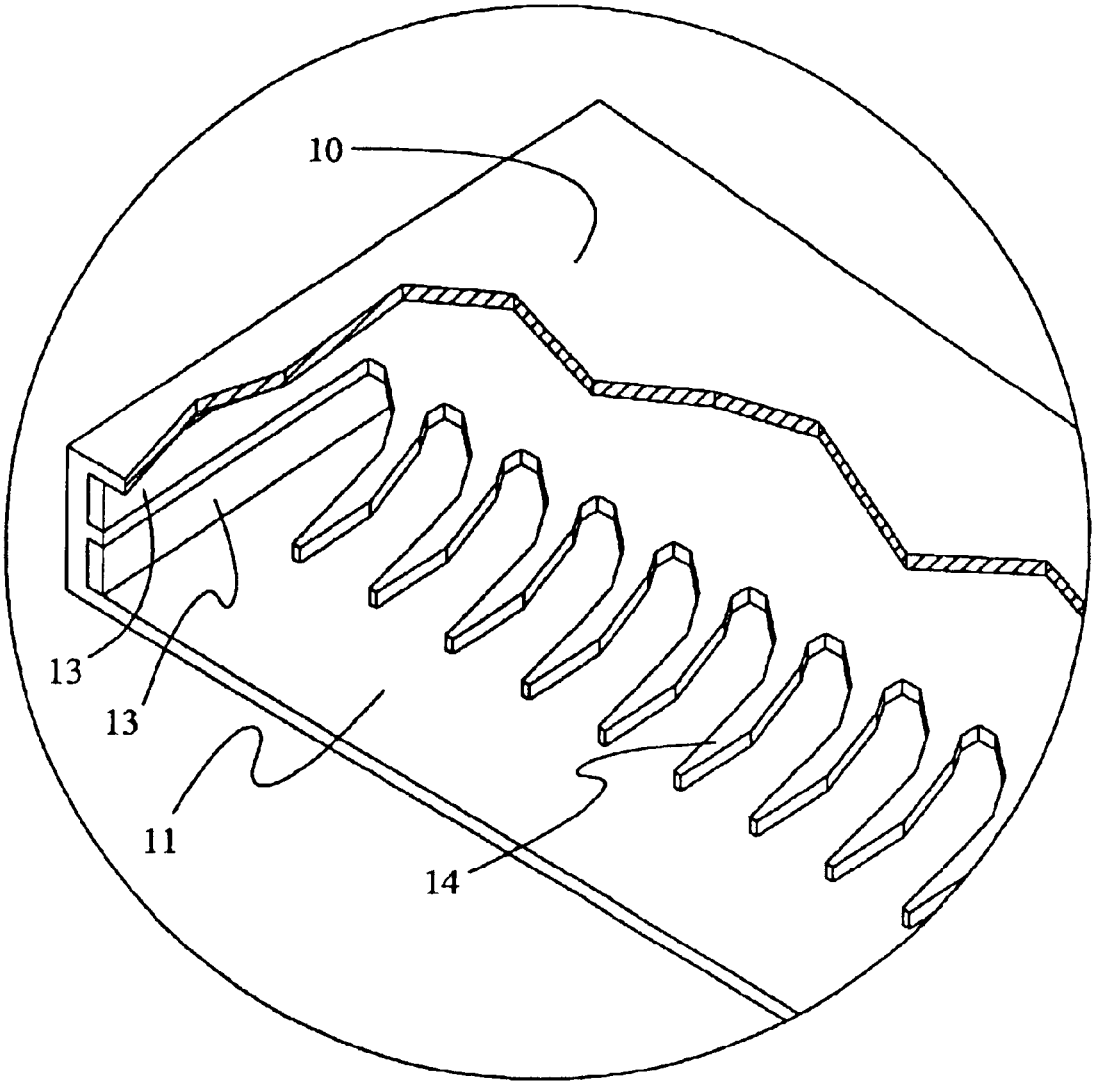
FIG. 5 is a second perspective drawing of the invention, showing closer detail of some of the teeth and the dielectric cladding of the side wall.

A prior art, rectangular waveguide, septum polarizer is illustrated in FIGS. 1 to 3. The upper and lower rectangular waveguide regions are labeled 1 and 2 respectively. The square waveguide region is labeled 3. The central common wall is labeled 4. The other walls of the waveguides are labeled 5. These diagrams show a stepped septum, 4, version of the polarizer.

The cross-section dimensions of the upper and lower waveguides are identical. Let a be the broad dimension and b the narrow dimension. Let the common wall have a thickness of w. b is normally chosen so that the guide 3 is square, i.e. a=b+b+w. a is chosen so that only the $TE_{10}$ mode propagates in the upper and lower waveguides and only the $TE_{10}$ and $TE_{01}$ modes propagate in guide 3. This requires that $$\frac{\lambda_{max}}{2} < a < \frac{\lambda_{min}}{\sqrt{2}} \tag{1}$$

where $\lambda_{min}$ and $\lambda_{max}$ are, respectively, the minimum and maximum wavelengths in the operating frequency band for the material filling the waveguides. An explanation of the modes and their nomenclature is given in sections 8.2 and 8.7 of "Fields and Waves in Communication Electronics, Second Edition" by Simon Ramo, John R. Whinnery and Theodore Van Duzer.

This structure is analyzed by separately analyzing the performance of the device when it is excited by two orthogonal modes. In the even mode operation the $TE_{10}$ modes in the upper and lower guides have the same amplitude and phase and have their electric fields oriented both in the same direction parallel to the narrow sides of the guides. Due to the symmetry of the field structures of each of the modes, this combination of modes only couples to the $TE_{10}$ mode in the square guide. In the odd mode operation, the $TE_{10}$ modes in the upper and lower guides have the same amplitude and phase but have their electric fields oriented in opposite directions parallel to the narrow sides of the guides. Due to symmetry, this combination of modes only couples to the $TE_{01}$ mode in the square guide.

It is not possible to write a closed form expression for the dimensions of the taper in the central wall, 4. These dimensions are found by an optimization process, i.e. an initial guess is made for the shape of the shaped septum, 3. A computer analysis program is used to analyze the two scenarios (even and odd excitation). The reflection coefficients and insertion phases for each mode are found. Some or all the septum's dimensions are changed and the structure is re-analyzed. This process is repeated many times until the reflection coefficients are reduced to an acceptable level and the difference in the insertion phases for the odd and even excitations is close to ±90°. Typically for a 4% frequency band, the reflection coefficients can be reduced to less than 26 dB and the difference in the insertion phases can be made to lie within 1° of the ±90° target for circular polarization.

Commercial computer analysis and optimization programs required for the design process are now readily available.

Figure 7:
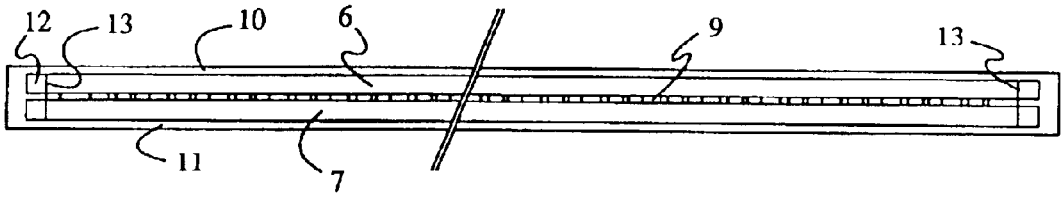
FIG. 7 is an end view of the invention. This sketch shows clearly the upper and lower parallel plate waveguides and the teeth edges.
Figure 8:
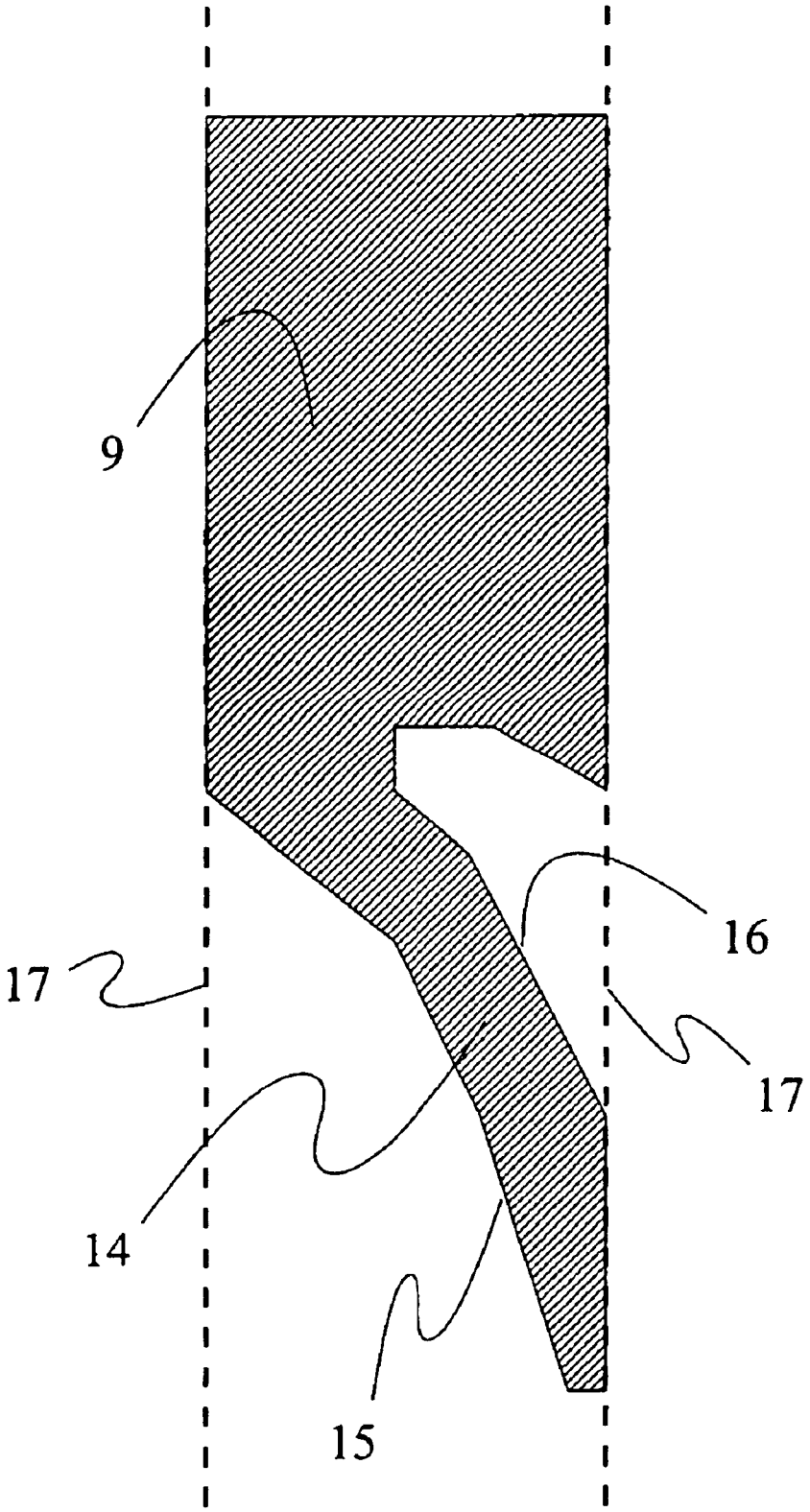
FIG. 8 is a plan view of the single tooth structure used to model the polarizer. The Floquet boundary planes are marked with broken lines. Note that the Floquet boundaries can be moved anywhere along the X axis, as long as their separation equals t, the tooth width.

The invention has a construction somewhat similar to that of the rectangular waveguide septum polarizer. FIGS. 4 to 7 show an implementation of the device. The upper and lower parallel plate regions are labeled 6 and 7 respectively. Region 6 is bounded by the upper plate, 10, and the common central plate, 9. Region 7 is bounded by the lower plate, 11 and the central plate, 9, all as best shown in FIG. 7. The larger parallel plate waveguide bounded by the upper and lower plates, 10 and 11 is labeled 8. The shaping of the outline of the central plate, 9 is formed by a linear array of polarizer "teeth". Each tooth, 14, is formed from a front edge, 15, which in this example, is comprised of a number of straight sections, and a back edge, 16, which in this example, is also comprised of a number of straight sections, as shown in FIG. 8. The sides of the parallel plate regions can be terminated by various ways. One way is to clad the side walls with a layer of low loss dielectric, 12. By appropriate design the interface surface between the dielectric and the air regions, 13, can act as a narrow band equivalent to a magnetic wall. This is useful if one wishes the electric fields perpendicular to the plates to be uniform across the aperture.

Let the spacing between the central plate and the upper plate be s. The same spacing is used between the lower and central plates. The thickness of the central plate is w. s is chosen to allow only the TEM modes propagate in the upper and lower guides, 6 and 7. s and w are chosen to allow only the TEM, $TE_1$ and $TM_1$ modes to propagate in the larger guide, 8. This places the following constraints on s and w.

$$s < \frac{\lambda_{min}}{2} \tag{2}$$

$$2s + w > \frac{\lambda_{max}}{2} \tag{3}$$

$$2s + w < \lambda_{min} \tag{4}$$

An explanation of the modes and their nomenclature is given in sections 8.2 and 8.3 of "Fields and Waves in Communication Electronics, Second Edition" by Simon Ramo, John R. Whinnery and Theodore Van Duzer. Note that the plate separation in this book is referred to as "a" whereas here it is referred to as "s" for the narrow guides and "2s+w" for the wide guide.

The shape of the outline of the central plate resembles a row of teeth in a heavy wood saw. The spacing of the teeth, t, is chosen to avoid grating lobes. Grating lobes are well known phenomena produced by array antennas. See pages 19–6 and 19–7 of "Antenna Engineering Handbook" Second Edition, edited by R. C. Johnson and H. Jasik. The septum polarizer will have similar phenomena if t is too large. A rule of thumb for the selection of t is given below:

$$t < \frac{\lambda_{\min}}{1 + (\lambda_{\max}/L) + |\cos(\theta)|} \tag{5}$$

Figure 6:
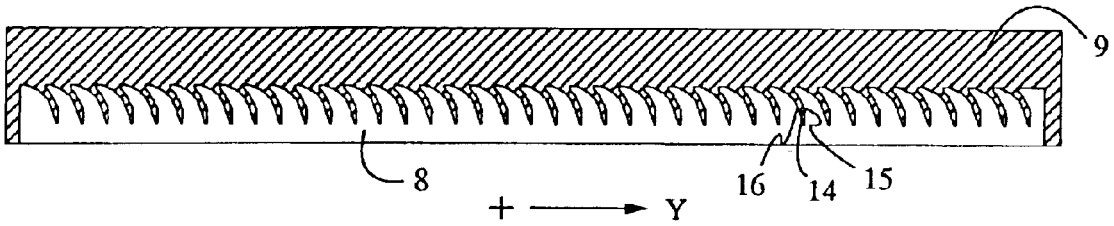
FIG. 6 is a cross-section view of the invention. The section is taken through the center of the center septum plate.

The waves pass over the polarizer teeth at an angle of θ to the Y axis (which is shown in FIG. 6). L is the total length of the row of teeth.

This invention is analyzed by separately analyzing the performance of the device when it is excited by two orthogonal modes. In the even mode operation the TEM modes in the upper and lower guides have the same amplitude and phase and have their electric fields oriented both in the same direction perpendicular to the plates. Due to the symmetry of the field structures of each of the modes, this combination of modes only couples to the TEM mode in the large guide 8. In the odd mode operation, the TEM modes in the upper and lower guides have the same amplitude and phase but have their electric fields oriented in opposite directions perpendicular to the plates. Due to symmetry, this combination of modes only couples to the $TE_1$ and $TM_1$ modes in the large guide.

It is not possible to write a closed form expression for the dimensions of the teeth in the central wall, 14. As with the rectangular waveguide polarizer, the design is performed by computer optimization. The goals of the optimization are the minimization of the reflection coefficients of the even and odd modes, and the minimization of the excitation of the unwanted $TM_1$ mode.

The modeling of the teeth structure is much less straight forward than that for the rectangular waveguide polarizer. For the latter, the whole structure can be analyzed by many commercial software packages. For the invention, it is not practical to analyze the whole structure. Rather, only one tooth is analyzed. It is assumed that the waves incident on the line of teeth all have the same y dependence of $e^{jk_y y}$, where is $k_y$ is the wave number in the Y direction. With this assumption, it is possible to place Floquet boundary planes, 17, on each side of one tooth as shown in FIG. 8. One only needs to model the tooth and the slices of waveguides adjoining it. Now the device being analyzed looks very similar to the rectangular waveguide septum polarizer but this is illusory since the latter has electric walls instead of Floquet boundaries, and the tooth has two edges, 15 and 16 to optimize instead of one. Also the field structures for all modes are very different in the two devices. Lastly, the optimization goals are different due to the presence of the unwanted propagating mode in the wider parallel plate guide.

A major problem in the design of the invention is that few, if any, commercial packages can analyze the single isolated tooth of the polarizer. This is due to the use of Floquet boundaries and the existence of uncommon waveguide modes. However, many public domain simple codes can be modified to analyze the structure. The code in a PhD thesis by Jack Wills "TLM Analysis of Waveguide Propagation and Scattering" University of California, Los Angeles, 1991 was modified to produce the design shown in FIGS. 4 to 7.

This polarizer has been drawn to scale. It was used in a low profile antenna operating in the DBS band from 12.2 GHz to 12.7 GHz. s and w are 0.25 inches and 0.084 inches respectively. The isolation between waveguides 6 and 7 was better than −25 dB and the coupling to the unwanted $TM_1$ mode is less than −18 dB. The angle of incidence of the waves to the Y axis was 90°. The teeth repeated every 0.75 inches and the length of the teeth was 1.167 inches. The dielectric cladding, 12, on the side walls was formed from polycarbonate. The thickness of the cladding was 0.172 inches.

Thus, there has been illustrated and described a unique and novel Parallel Plate Septum Polarizer for Low Profile Antenna Applications. and which thereby fulfills all of the objects and advantages which have been sought. It should be understood that many changes, modifications, variations and other uses and applications which will become apparent to those skilled in the art after considering the specification and the accompanying drawings. Therefore, any and all such changes, modifications, variations and other uses and applications which do not depart from the spirit and scope of the invention are deemed to be covered by the invention.

Having thus described the invention, what we desire to claim and secure by letters patent is:

1. A parallel plate septum polarizer comprising:

a) three generally parallel electrically conductive plates comprised of a first plate, a second plate and a third plate with spatial separation therebetween;

b) a space between the first and second plates forming a waveguide A;

c) a space between the second and third plates forming a waveguide B;

d) the first and third plates extending beyond the second plate and with the space between the first and third plates beyond the second plate forming a waveguide C;

e) a plurality of projections extending outwardly from the body of the second plate and which generally extend in angularly related directions into the waveguide C;

f) the periphery of the projections on the second plate and the edge on the second plate front which the projections extend defining a boundary between waveguides A and C and a boundary between waveguides B and C; and g) the length of each projection, measured from the base of the projection where it extends from the edge of the second plate to a tip thereof, is on the order of or longer than the shortest wavelength in the media which fills the spaces between the plates.

2. The parallel plate septum polarizer of claim 1 wherein the array of projections is a linear array.

3. The parallel plate septum polarizer of claim 1 wherein each of the projections have a similar shape.

4. The parallel plate septum polarizer of claim 1 wherein the projections have a smooth outline.

5. The parallel plate septum polarizer of claim 1 wherein the projections have a stepped outline.

6. The parallel plate septum polarizer of claim 1 wherein the projections have an outline which is a combination of smooth and stepped sections.

7. The parallel plate septum polarizer of claim 1 wherein the projections form a saw tooth shaped pattern.

8. The parallel plate septum polarizer of claim 1 wherein the projections are spaced apart from one another by a distance sufficient to prevent significant excitation of grating lobe modes.

9. The parallel plate septum polarizer of claim 1 wherein the spacing between the first and third plates is less than ½ the wavelength in the media which fills the space between these plates.

10. The parallel plate septum polarizer of claim 1 wherein the first and third plates flare away from a plane of the second plate.

11. A parallel plate septum polarizer comprising:

a) three generally parallel electrically conductive plates allowing for a plurality of different propagating waveguide modes;

b) the space between the first and second plates forming a waveguide A in which a waveguide mode can propagate;

c) the space between the second and third plates forming a waveguide B in which a waveguide mode can propagate;

d) the first and third plates extending beyond the second plate;

e) the space between the extended first and extended third plates forming a waveguide C in which three or more waveguide modes can propagate, two of which are desirable waveguide modes but have different field structures, wave velocities and impedances, waveguide C being fed by waveguides A and B;

f) the propagating mode in waveguide A coupling most or all its power to the two desired waveguide modes in waveguide C and coupling minimally to the undesired modes in waveguide C and coupling minimally to the propagating mode in waveguide B; and g) the propagating mode in waveguide B coupling most or all its power to the two desired modes in waveguide C and coupling minimally to the undesired modes in waveguide C and coupling minimally to the propagating mode in waveguide A.

12. The parallel plate septum polarizer of claim 11 wherein a plurality of projections which generally extend in angularly related directions into waveguide C extend outwardly from the body of the second plate.

13. The parallel plate septum polarizer of claim 12 wherein the length of each projection, measured from the base of the projection where it extends from the second plate to the tip thereof, is on the order of or longer than the shortest wavelength in the media which fills the spaces between the plates.

14. The parallel plate septum polarizer of claim 12 wherein the array of projections is a linear array.

15. The parallel plate septum polarizer of claim 12 wherein the projections have a similar shape.

16. The parallel plate septum polarizer of claim 12 wherein the projections have a smooth outline.

17. The parallel plate septum polarizer of claim 12 wherein the projections have a stepped outline.

18. The parallel plate septum polarizer of claim 12 wherein the projections have an outline which is a combination of smooth and stepped sections.

19. The parallel plate septum polarizer of claim 12 wherein the projections are spaced apart from one another by a distance sufficient to prevent significant excitation of grating lobe modes.

20. The parallel plate septum polarizer of claim 12 wherein the projections form a saw tooth shaped pattern.

21. The parallel plate septum polarizer of claim 11 wherein the spacing between the first and third plates is less than ½ the wavelength in the media which fills the space between these plates.

22. The parallel plate septum polarizer of claim 11 wherein the first and third plates flare away from the plane the second plate.

23. A parallel plate septum polarizer comprising:

a) three generally parallel electrically conductive plates comprised of a first plate, a second plate and a third plate with spatial separation therebetween;

b) a space between the first and second plates forming a waveguide A;

c) a space between the second and third plates forming a waveguide B;

d) the first and third plates extending beyond the second plate and with the space between the first and third plates beyond the second plate forming a waveguide C;

e) a plurality of projections extending outwardly from an edge of the second plate and which generally extend in angularly related directions into the waveguide C;

f) each of said projections having a base where the projection is connected to said edge and a tip spaced outwardly of said base and side portions extending between the tip and base; and g) a side portion of each of the projections facing an opposed side portion on the next adjacent projection.

24. The parallel plate septum polarizer of claim 23 wherein the periphery of the projections on the second plate and the edge on the second plate from which the projections extend defining a boundary between waveguides A and C and a boundary between waveguides B and C.

25. The parallel plate septum polarizer of claim 24 wherein the length of each projection from a base of the projection where it extends from the edge to a tip thereof is on the order of one wavelength or longer.

26. The parallel plate septum polarizer of claim 23 wherein the array of projections is a linear array.

27. The parallel plate septum polarizer of claim 23 wherein each of the projections have a similar shape.

* * * * *